US005261940A

United States Patent [19]

Berczik

[11] Patent Number: 5,261,940

[45] Date of Patent: Nov. 16, 1993

[54] BETA TITANIUM ALLOY METAL MATRIX COMPOSITES

[75] Inventor: Douglas M. Berczik, Palm Beach Gardens, Fla.

[73] Assignee: United Technologies Corporation, Hartford, Conn.

[21] Appl. No.: 364,670

[22] Filed: May 8, 1989

Related U.S. Application Data

[63] Continuation of Ser. No. 947,573, Dec. 23, 1986, abandoned.

[51] Int. Cl.[5] ..... C22C 29/02; C22C 14/00

[52] U.S. Cl. ..... 75/236; 75/244; 420/421; 420/588

[58] Field of Search ..... 420/421, 588; 148/11.5 F, 421, 442; 75/236, 244

[56] References Cited

U.S. PATENT DOCUMENTS

| | | | |
|---|---|---|---|
| 2,754,203 | 7/1956 | Vordahl | 420/421 |
| 3,131,059 | 4/1964 | Kaarlela | 420/421 |
| 3,644,153 | 2/1972 | Rausch et al. | 148/31.5 |
| 3,673,038 | 6/1972 | Canonico et al. | 29/195 |
| 3,971,656 | 7/1976 | Rudy | 420/421 |
| 3,986,868 | 10/1976 | Crossley | 420/421 |
| 3,991,928 | 11/1976 | Friedrich et al. | 228/190 |
| 4,437,888 | 3/1984 | Jecker | 420/421 |
| 4,499,156 | 2/1985 | Smith et al. | 428/614 |
| 4,639,281 | 1/1987 | Sastry et al. | 420/421 |
| 4,807,798 | 2/1989 | Eylon et al. | 228/190 |
| 4,809,903 | 3/1989 | Eylon et al. | 228/194 |

FOREIGN PATENT DOCUMENTS

| | | | |
|---|---|---|---|
| 58-217654 | 12/1983 | Japan | 420/421 |
| 1175683 | 12/1969 | United Kingdom . | |

OTHER PUBLICATIONS

Ferrous Metals, vol. 78, p. 191.

The Beta Titanium Alloys, by F. H. Froes and H. B. Bomberger, pp. 28 through 37.

*Primary Examiner*—Donald P. Walsh
*Assistant Examiner*—Ngoclan T. Mai
*Attorney, Agent, or Firm*—Charles E. Sohl

[57] ABSTRACT

Composite materials comprising beta titanium alloy matrices containing high strength, high stiffness filaments are described. The matrix materials are true beta titanium alloys having very limited solid solubility for the filament materials. This low reactivity permits high fabrication temperatures and high use temperatures without formation of deleterious brittle phases. Also described is a method for fabricating such composites.

2 Claims, 1 Drawing Sheet

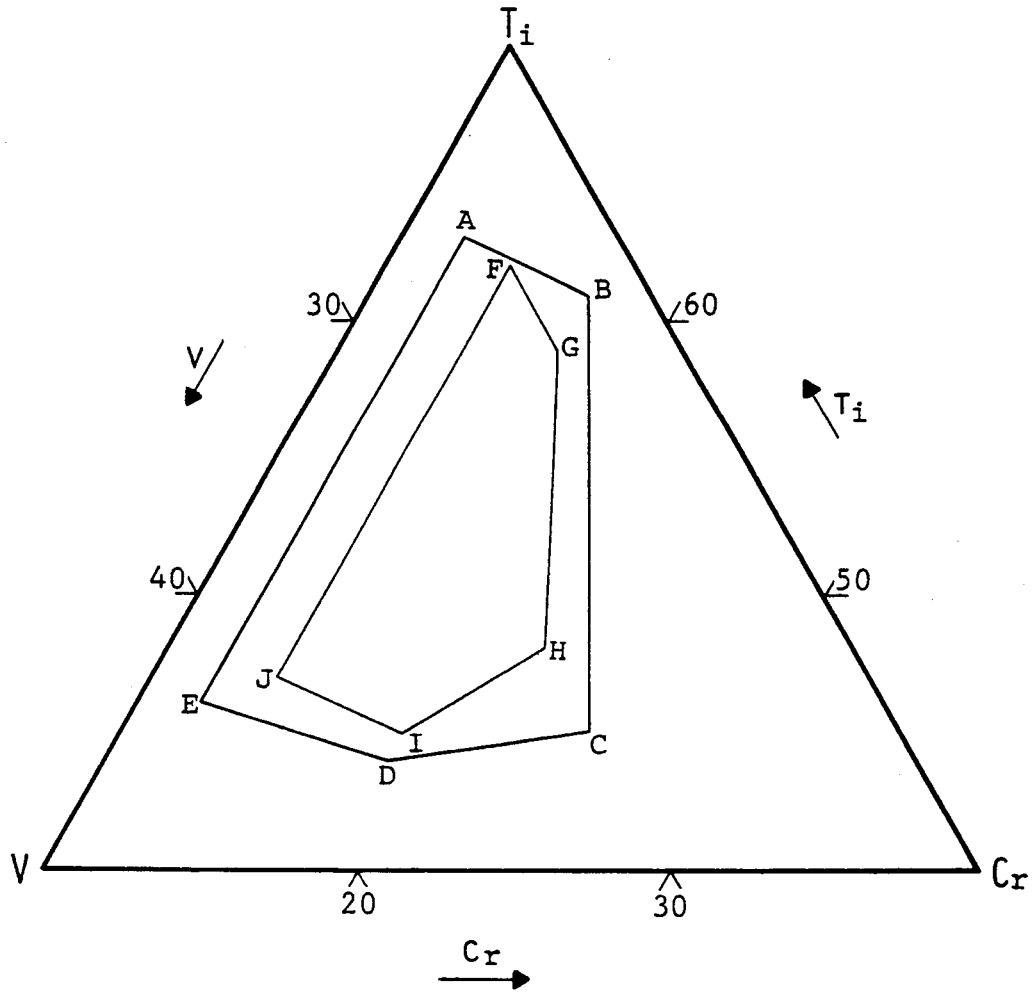
Ti
A
F
B
30
60
V
G
Ti
40
50
H
J
E
I
C
D
V
Cr
20
30
Cr

BETA TITANIUM ALLOY METAL MATRIX COMPOSITES

This is a continuation of Ser. No. 947,573 filed Dec. 23, 1986, now abandoned.

TECHNICAL FIELD

The present invention relates to metal matrix composite materials and specifically to composite materials having a (Ti-V-Cr) beta titanium alloy matrix.

BACKGROUND ART

There is a constant demand for improved materials, especially for aerospace applications. One area for which improved materials are sought is structural materials having a high strength to weight ratio and/or a high stiffness to weight ratio.

Fiber materials which have exceptional combinations of strength and modulus are commercially available. Practical use of such fibrous materials can be made by embedding the fibers in a matrix which can transmit stress so that a bulk article having properties derived in part from the fiber materials can be produced.

High performance fibers produced to date have included graphite, silicon carbide, and boron. Fibers of these classes coated with other materials such as graphite, boron and boron carbides are also available.

Titanium is a natural candidate for a matrix material suited for use at high temperatures and having good inherent properties, Unfortunately, titanium alloy-fiber combinations used heretofore have been generally unsuccessful because the prior titanium alloys have had significant solid solubility for the fiber materials. This solid solubility characteristic is detrimental to the composite material since during high temperature fabrication and/or use of the resultant composite interdiffusion occurs between the matrix and the fiber, forming an intermediate zone of a brittle titanium intermetallic compound. A continuous brittle layer between the fiber and the composite is highly detrimental to the composite properties.

U.S. Pat. No. 4,499,156 which issued in Feb. 12, 1985 describes a typical prior art titanium-fiber composite material.

It is an object of the present invention to provide improved titanium matrix composites. It is another object of this invention to provide an improved method for fabricating titanium matrix composites. Other objects, aspects and advantages of the present invention will be apparent to those skilled in the art from consideration from the following description of the invention and the attached claims. In what follows, percent values are weight percent unless otherwise noted.

DISCLOSURE OF INVENTION

The present invention provides an improved titanium metal matrix-fiber composite consisting of fibers of graphite; graphite coated with boron or boron carbide; silicon carbide coated with graphite, boron, or boron carbide; and boron which may be coated with graphite or boron carbide, embedded in a beta titanium alloy matrix. A key feature of the invention is the titanium metal matrix which is a true beta titanium alloy. Matrix compositions are described in U.S. Ser. No. 06/948,390, U.S. Pat. No. 5,176,762 and U.S. Ser. No. 07/004,206 filed on even date herewith. A typical matrix composition is 35% V, 15% Cr, balance Ti. A method of the invention comprises laying an array of fibers between two sheets of the matrix material and pressing these sheets together at a high temperature where the titanium flow stress is low in order to provide flow and bonding of the titanium sheets to each other and to the fiber material without fracturing or otherwise damaging the fibers. Powder metallurgy techniques may also be employed. The particular titanium alloy matrix employed has exceptionally low reactivity with the fiber materials permitting a high processing temperature without excess reaction with the fibers. This high processing temperature leads to a low bonding stress requirement and consequent easy bonding of the composite components. In addition, the titanium material employed has better high temperature mechanical properties than other commercial titanium alloys. This permits use of the composite material at higher temperatures than metal matrix composites based on prior art titanium alloys and concomitantly the low reactivity between the matrix and the fiber reinforcement in the present invention inhibits the formation of any detrimental reaction zone during such elevated temperature exposure.

The foregoing, and other features and advantages of the present invention will become more apparent from the following description and accompanying drawing.

BRIEF DESCRIPTION OF DRAWING

The FIGURE shows a portion of the Ti-V-Cr diagram, illustrating invention matrix compositions.

BEST MODE FOR CARRYING OUT THE INVENTION

A method of the present invention comprises starting with beta titanium alloy sheet stock of composition to be described below, fabricating preformed shapes from the sheet material the desired size, laying up at least one titanium sheet separated from at least one other titanium sheet by an array of fibers, heating this sandwich assembly to an elevated temperature e.g. 1800° F. and applying a moderate load e.g. 30 ksi for a period of time sufficient to cause plastic flow and bonding to occur. Composites may also be produced from the same matrix material in powder form by mixing fibers and powder and then compacting the mixture. Compacting may be accomplished by hot isostatic pressing or extrusion.

The matrix beta titanium alloy composition will now be described with reference to the FIGURE which is a portion of the titanium-chromium-vanadium ternary phase diagram and the matrix composition is selected to fall within the region lying within points A, B, C, D and E. A preferred range is defined by points F, G, H, I and J. Table I defines points A through J. A typical alloy is 35 percent chromium, 15 percent vanadium, balance titanium. A variety of other alloying elements may be added as depicted in Table II provided that the sum in total of the alloying elements is insufficient to cause formation of a detrimental second phase material (additions of Table II elements are in partial substitution for titanium). It is contemplated that up to about 2.0% carbon and up to about 3 percent silicon may be added, and amounts of silicon in excess of about 0.3 weight percent will cause the formation of the second phase based on $Ti_5Si_3$ which has been shown to be a potent strengthening phase and which permits development of enhanced mechanical properties by solution heat treatment and aging as will be discussed below. Carbon is useful for grain size and for maintaining ductility during and after creep. Other particularly promising alloying elements are Nb, Zr, Re and Hf.

If the matrix material contains more than about 13% Cr it will be nonburning under gas turbine engine conditions, and more than about 15.1% Cr is preferred. The titanium matrix composition is the subject of U.S. Ser. Nos. 06/948,390 and 07/004,206 filed on even date herewith. Nonburning means that the materials will not undergo sustained combustion at 850° F. in air at 100 psi flowing at 450 feet per second after deliberate ignition with a laser.

The fibers utilized in the present invention are commercially available as follows: carbon coated SiC a product of AVCO, graphite fibers, a product of Union Carbide, boron fibers a product of Hercules, boron carbide coated boron fibers a product of AVCO, and boron coated SiC fibers a product of AVCO. Similar fibers are also available from other suppliers.

To be used with the invention the fibers must have an outer surface comprised essentially of carbon, boron or boron carbide since these materials are generally inert with respect to the previously described matrix materials in the solid state. The low reactivity permits higher processing and use temperatures than those conventionally used with titanium-fiber composites and this is beneficial since it reduces the flow stress and increases the likelihood of complete bonding between the composite constituents.

The applicable composite fabrication processes are generally similar to those known in the art although the use of the particular titanium matrix material described above permits modification of particular processing parameters in an advantageous fashion. Typically alternate layers of titanium sheet and arrays of reinforcing fibers will be employed. As is well known, alternating fiber layers may be oriented at 90° to each other or other angular relationship depending on the anticipated stresses in the final product. Alternately, random fiber arrays may provide the necessary composite properties. In the case of powder matrix fabrication random arrays will be the practical arrangement.

The titanium sheet stock material can be processed by rolling to thicknesses ranging from about 0.003 to 0.030 inch or greater. A sheet stock thickness of about 0.005 inch would be typical. It is a characteristic of the preferred matrix material employed in the present invention that it is malleable and highly cold rollable without the necessity for intermediate anneals which would otherwise increase the cost of processing. The amount of filamentary material to be included in the composite structure can be varied according to the anticipated need but would typically range from about 10 to about 45 volume percent of fibers.

Consolidation of the preform assembly is accomplished with heat and pressure. Cleanliness is essential for uniform bonding. In particular, since titanium is susceptible to oxidation it is preferred that the titanium alloy sheets be acid cleaned immediately prior to compaction. Compaction is performed under vacuum conditions to minimize matrix oxidation. Typical conditions are a temperature of 1800° F., bonding stress of 30 ksi and a bonding time of about one hour. More generally, bonding temperatures of between about 1650° and 1950° F. can advantageously be used and bonding pressures may range from 10 up to about 50 ksi. Higher temperatures and higher bonding pressures will decrease the amount to time require to achieve bonding.

The following illustrative example describes the process.

Sheet stock material made of an alloy comprising 35% chromium, 15% vanadium, balance titanium and containing 0.15% carbon was fabricated to a thickness of about 0.005 inches by hot and cold rolling. Shaped sections were cut from this titanium alloy sheet stock material and were placed in a correspondingly shaped die cavity. Arrays of graphite fibers were placed between the sheets and a mating die shaped to fit the cavity was then positioned to apply pressure to the composite assembly. The fibers comprised 15 volume percent of the composite. Bonding was carried out in a vacuum of less than about $10^{-3}$ mm hg at a temperature of 1800° F. and an applied pressure of 30 ksi for a period of one hour. A progressive heat up schedule was employed to ensure degasing of the composite assembly to minimize gas entrapment.

Table III presents representative properties for the fiber, the matrix and the composite. If the matrix had contained, for example, 1% silicon the finished article could be heat treated by solution treating at about 1950° F. for about one hour, rapidly cooling to room temperature and then aging at 1100°-1500° F. for 1-10 hours.

Although this invention has been shown and described with respect to detailed embodiments thereof, it will be understood by those skilled in the art that various changes in form and detail thereof may be made without departing from the spirit and scope of the claimed invention.

TABLE I

| | Weight Percent | |
|---|---|---|
| | V | Cr |
| A | 25 | 12 |
| B | 22 | 17 |
| C | 30 | 25 |
| D | 37 | 19 |
| E | 42 | 12 |
| F | 24 | 14 |
| G | 24 | 17 |
| H | 30 | 22 |
| I | 36 | 19 |
| J | 39 | 14 |

TABLE II

| | Broad | Preferred |
|---|---|---|
| B | 0-0.6 | 0.1-0.5 |
| C | 0-2.0 | 0.1-1.5 |
| Co | 0-7.0 | 0.5-6.0 |
| Hf | 0-1.5 | 0.1-1.0 |
| Mo | 0-4 | 0.5-2.0 |
| Nb | 0-12 | 0.5-10.0 |
| O | 0-0.22 | 0.08-0.2 |
| Re | 0-1.5 | 0.01-1.0 |
| Si | 0-3.0 | 0.3-2.0 |
| W | 0-2.5 | 0.5-2.0 |
| Zr | 0-2.0 | 0.2-1.0 |
| Sn* | 0-2.5 | 0.1-2.0 |
| W* | 0-5.0 | 0.2-4.0 |

*Preferred ranges for Si free material

TABLE III

| | Room Temperature Properties | |
|---|---|---|
| | Elastic Modulus, psi | Yield Strength at Room Temp. |
| Fiber | $65 \times 10^6$ | 500 ksi |
| Matrix | $16 \times 10^6$ | 130 ksi |
| Composite | $30 \times 10^6$ | 160 ksi |

I claim:

1. A composite article including:

a beta titanium alloy matrix whose titanium, vanadium and chromium levels fall within the region defined by points A-B-C-D-E on FIG. 1 and which may further contain 0–3% Si, 0–2% C, and one or more elements from Table II, in the broad ranges, in amounts insufficient to produce more than about 1 volume percent of extraneous phases, said Si, C and Table II elements being added in partial replacement for titanium, said alloy matrix containing from about 10 to about 45 vol. % of strengthening fibers selected from the group consisting of graphite fibers, graphite fibers coated with boron, graphite fibers coated with boron carbide, silicon carbide fibers coated with graphite, silicon carbide fibers coated with boron, silicon carbide fibers coated with boron carbide, boron fibers, boron fibers coated with graphite and boron fibers coated with boron carbide, said fibers being bonded to said matrix and said fibers exhibiting low reactivity to each other.

2. A composite article as in claim 1 wherein the matrix contains more than about 13% Cr and is therefore nonburning.

* * * * *